US012163516B1

(12) United States Patent
Ziemba

(10) Patent No.: US 12,163,516 B1
(45) Date of Patent: Dec. 10, 2024

(54) PUMP ASSEMBLY FIXTURE

(71) Applicant: Rivian IP Holdings, LLC, Irvine, CA (US)

(72) Inventor: Jefferey Ziemba, Novi, MI (US)

(73) Assignee: Rivian IP Holdings, LLC, Irvine, CA (US)

( * ) Notice: Subject to any disclaimer, the term of this patent is extended or adjusted under 35 U.S.C. 154(b) by 0 days.

(21) Appl. No.: 18/330,231

(22) Filed: Jun. 6, 2023

(51) Int. Cl.

| | |
|---|---|
| ***B23P 15/00*** | (2006.01) |
| ***B23P 19/04*** | (2006.01) |
| ***F04C 2/10*** | (2006.01) |
| ***F04C 15/00*** | (2006.01) |

(52) U.S. Cl.
CPC ..... *F04C 15/0061* (2013.01); *F04C 2/10* (2013.01); *F04C 2230/60* (2013.01); *F04C 2240/30* (2013.01)

(58) Field of Classification Search
CPC ..... F04C 15/0061; F04C 2/10; B23P 15/00; B23P 19/04; Y10T 29/5326
USPC ..... 29/759, 760
See application file for complete search history.

(56) References Cited

U.S. PATENT DOCUMENTS 3,760,478 A * 9/1973 Harlin ..... F01C 21/0872 29/434
6,817,095 B2 * 11/2004 Foster ..... B23P 19/042 29/428
7,959,422 B2 * 6/2011 Nakakuki ..... F04C 2/102 418/61.3

* cited by examiner

*Primary Examiner* — Deming Wan
(74) *Attorney, Agent, or Firm* — Patterson + Sheridan, LLP

(57) ABSTRACT

An apparatus for facilitating the installation of pump components into a housing is provided. The apparatus includes a frame configured to be placed on the housing during assembly, and a clamp slidingly coupled to the frame. The frame includes a body, a first raised portion and a second raised portion. The first raised portion extends from the body, and is configured to support a portion of a drive gear. The second raised portion extends from the body, and is configured to support a portion of a port plate. The clamp is configured to secure the drive gear, the port plate, and a pump gear set to the frame. The pump gear set is coupled to the drive gear.

19 Claims, 16 Drawing Sheets

PUMP ASSEMBLY FIXTURE

INTRODUCTION

The present disclosure relates to a pump. More particularly, the present disclosure relates to a pump assembly fixture.

SUMMARY

Embodiments of the present disclosure advantageously provide an apparatus to facilitate the installation of pump components into a housing. The apparatus includes a frame configured to be placed on the housing during assembly, and a clamp slidingly coupled to the frame. The frame includes a body, a first raised portion and a second raised portion. The first raised portion extends from the body, and is configured to support a portion of a drive gear. The second raised portion extends from the body, and is configured to support a portion of a port plate. The clamp is configured to secure the drive gear, the port plate, and a pump gear set to the frame. The pump gear set is coupled to the drive gear.

DETAILED DESCRIPTION

Embodiments of the present disclosure are generally directed to features for a pump assembly fixture that facilitate the installation of pump components into a housing, such as the housing of a front drive unit (FDU) of an electric vehicle, the housing of a rear drive unit (RDU) of an electric vehicle, a stand-alone pump housing, etc.

During assembly, it is advantageous for the pump components to be simultaneously held in proper alignment not only to one another but also to several reference axes of the housing, oftentimes in an inverted position with respect to gravity. Additionally, because multiple pumps may be used on a vehicle, it is advantageous for the correct pump components to be selected for installation into each housing. While the wrong pump component, such as a gerotor, may fit into a particular housing, it may produce a failure when the pump is operated the first time.

Embodiments of the present disclosure advantageously improve the installation of pump components into a housing by simultaneously holding the pump components in proper alignment with respect to one another as well as to several reference axes of the housing during assembly (part of which may be performed while the pump assembly fixture is inverted). Additionally, many embodiments herein allow for only the correct pump components to be installed into the pump assembly fixture due to the various raised portions and recesses that are configured to only receive the correctly-dimensioned components.

Figure 1:
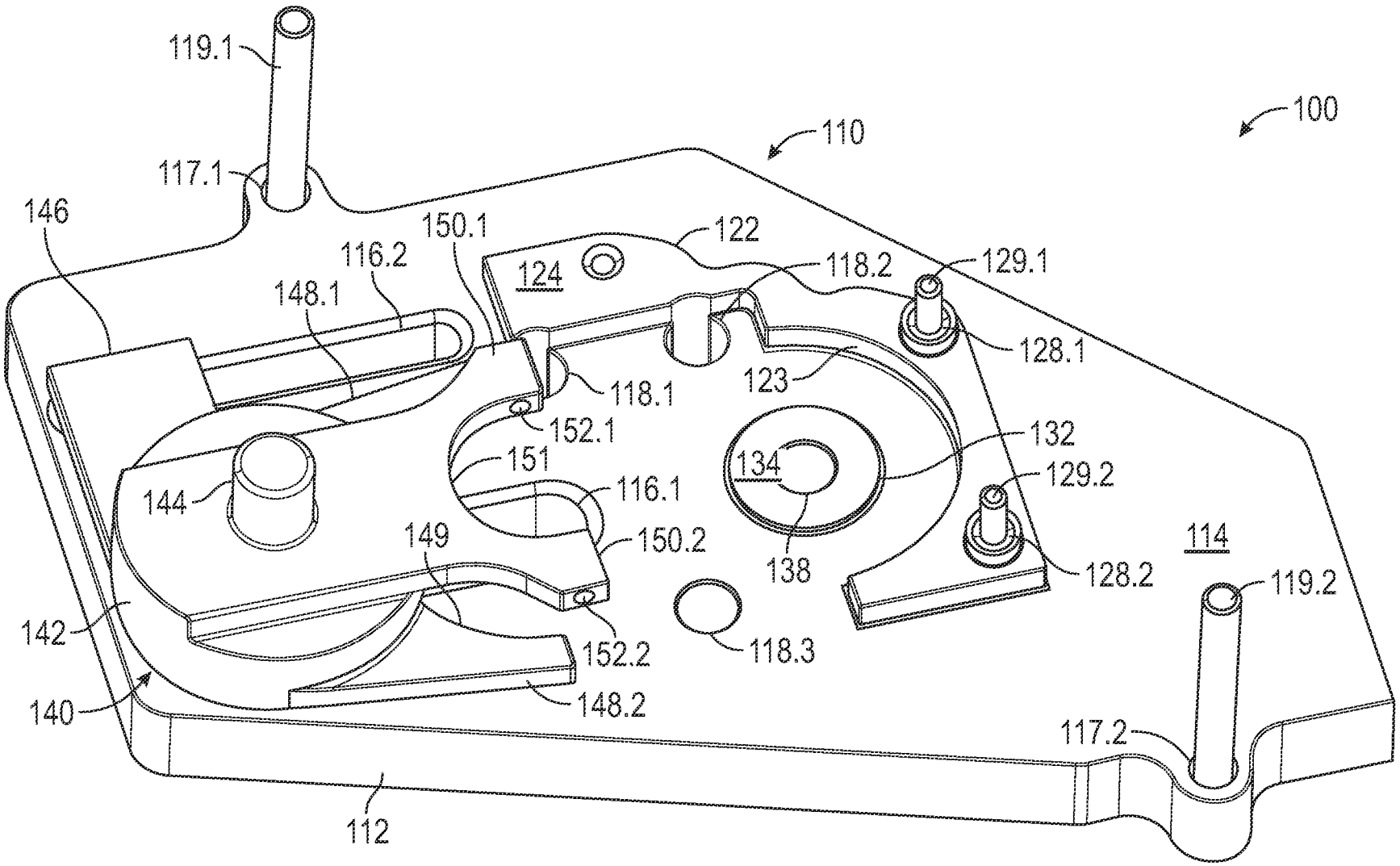
FIG. 1 depicts an example pump assembly fixture, in accordance with embodiments of the present disclosure.

For example, an apparatus is provided to facilitate the installation of pump components into a housing. The apparatus includes a frame configured to be placed on the housing during assembly, and a clamp slidingly coupled to the frame. The frame includes a body, a first raised portion and a second raised portion. The first raised portion extends from the body, and is configured to support a portion of a drive gear. The second raised portion extends from the body, and is configured to support a portion of a port plate. The clamp is configured to secure the drive gear, the port plate, and a pump gear set to the frame. The pump gear set is coupled to the drive gear FIG. 1 depicts pump assembly fixture 100, in accordance with embodiments of the present disclosure.

In many embodiments, pump assembly fixture 100 includes, inter alia, frame 110 and clamp 140. Frame 110 is configured to be attached to a housing during assembly, and clamp 140 is configured to secure certain pump components to frame 110.

Frame 110 includes body 112, upper surface 114, lower surface 115 (see FIG. 5A), raised portion 122 and raised portion 132. Body 112 defines a number of openings that extend from upper surface 114 to lower surface 115.

Figure 4B:
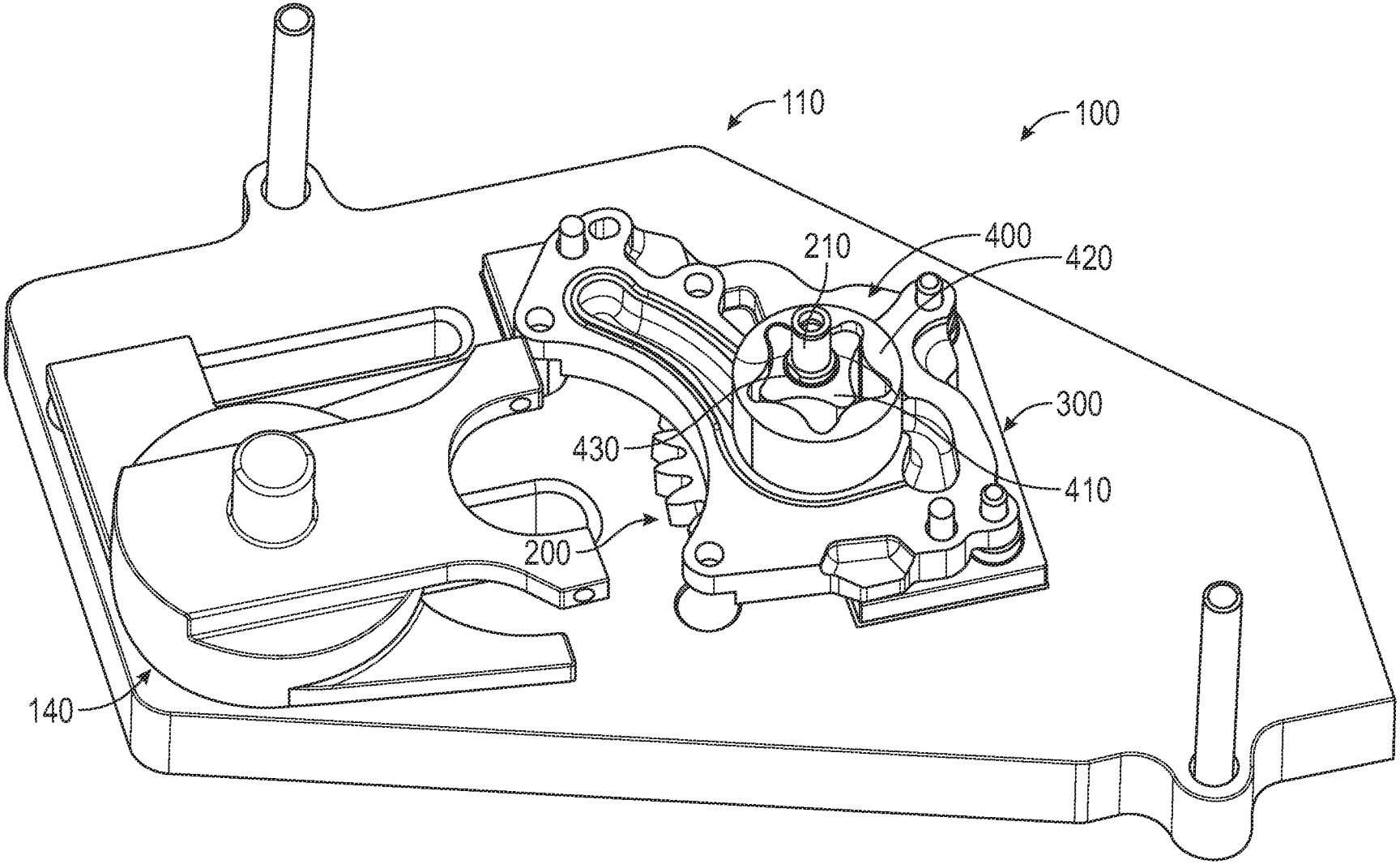
Figure 4C:
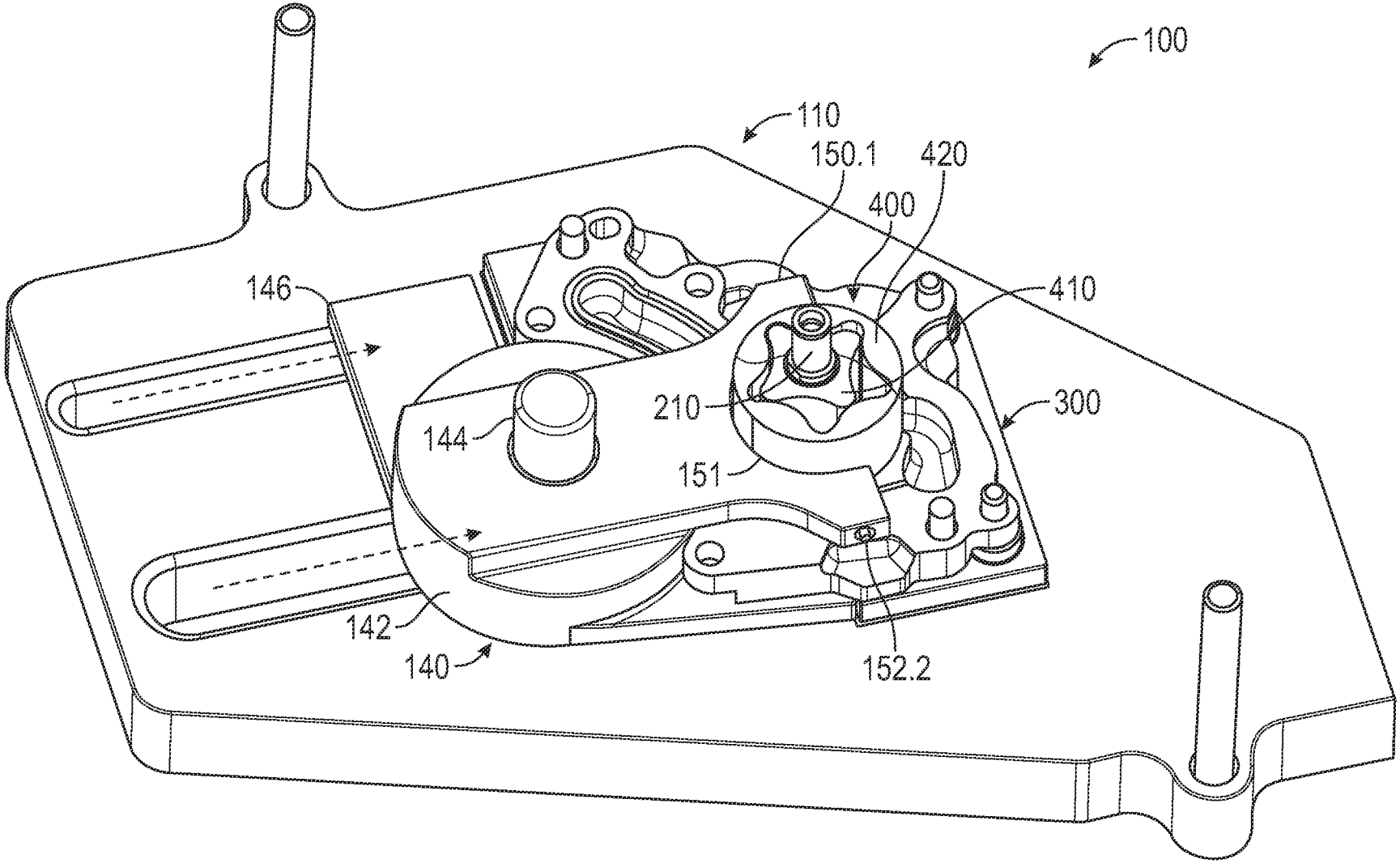
Figure 5A:
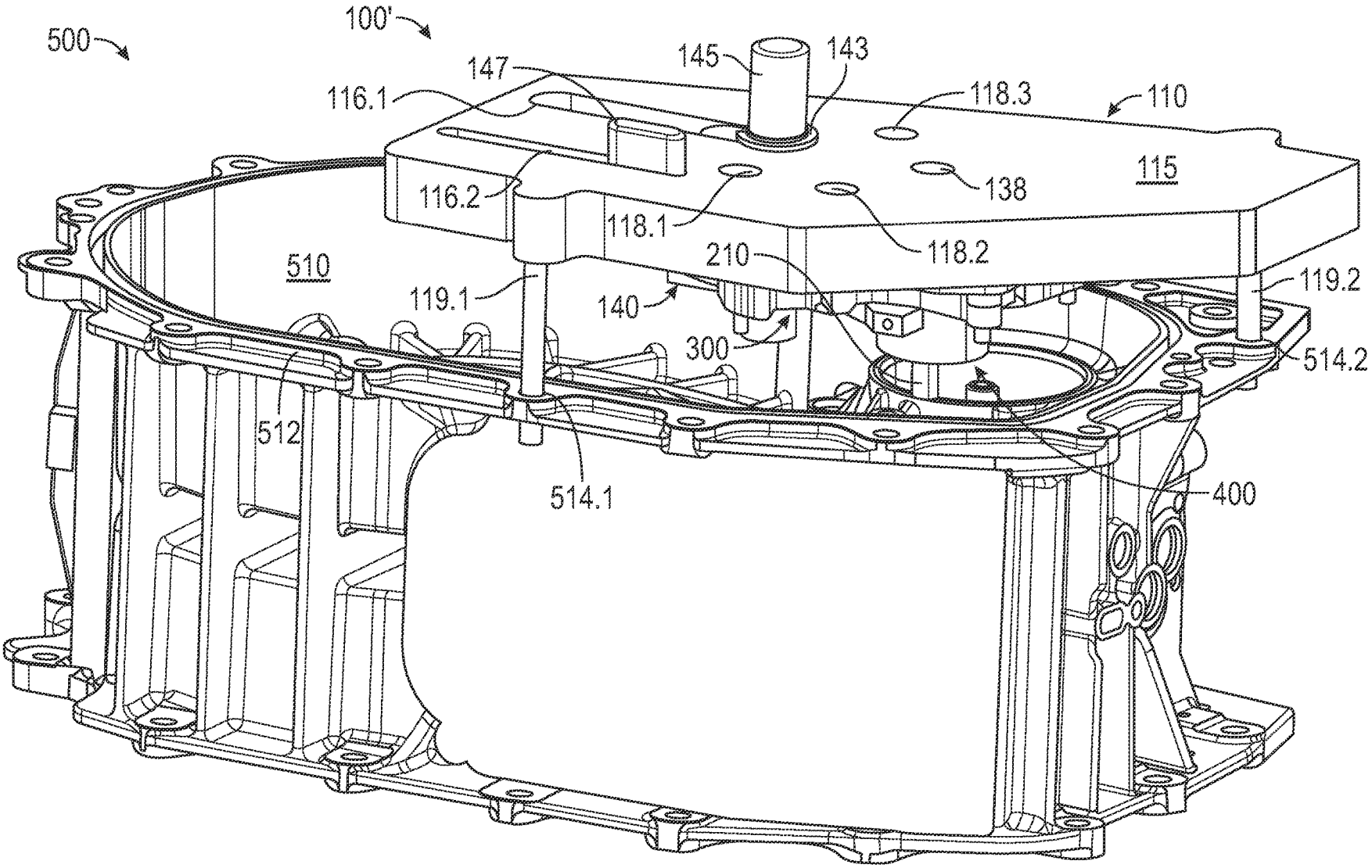
FIG. 5A depicts an example inverted pump assembly fixture, drive gear, port plate, pump gear set, and housing, in accordance with embodiments of the present disclosure.
Figure 5B:
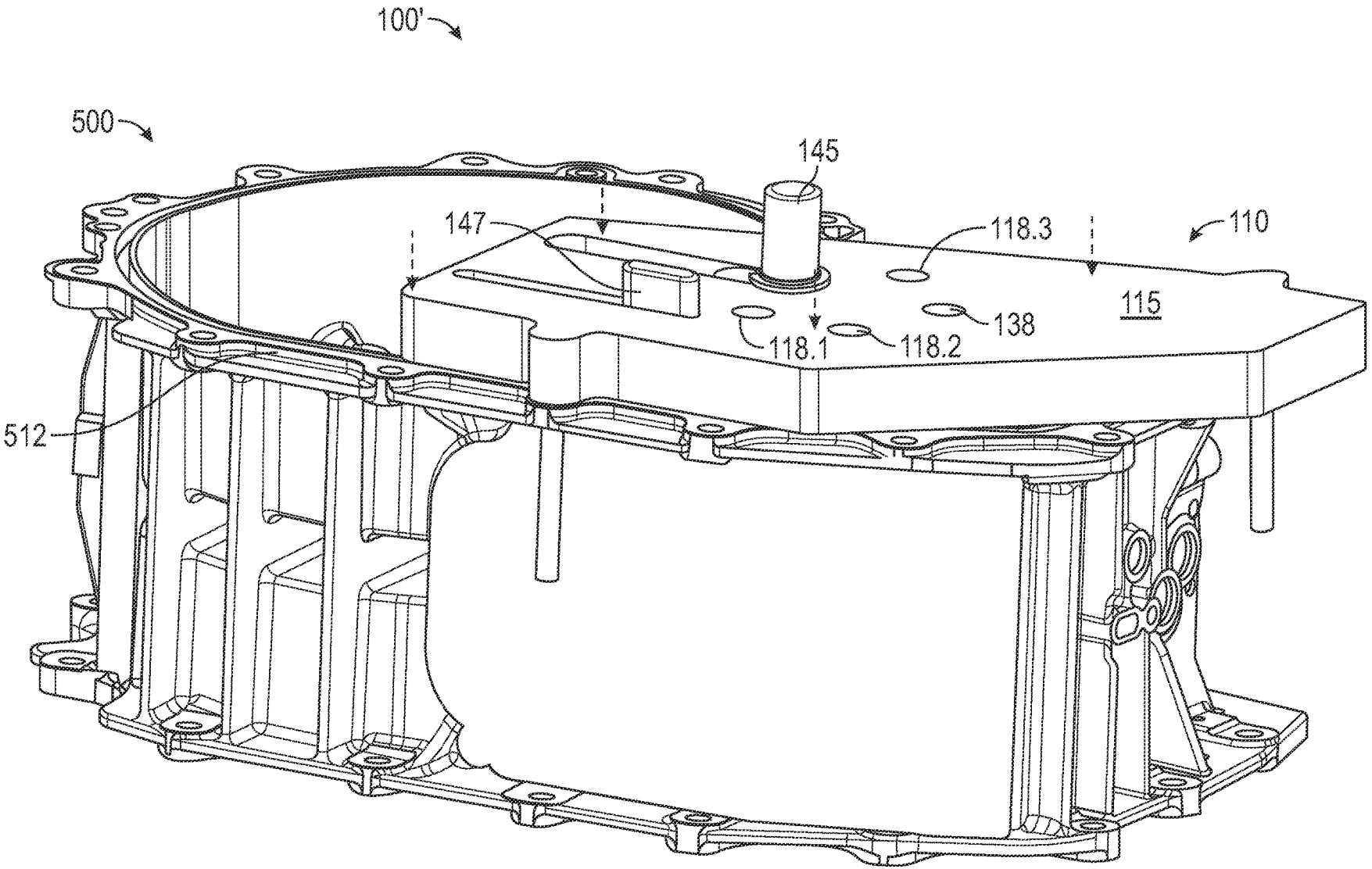
FIGS. 5B, 5C and 5D depict an example inverted pump assembly fixture and housing, in accordance with embodiments of the present disclosure.
Figure 5C:
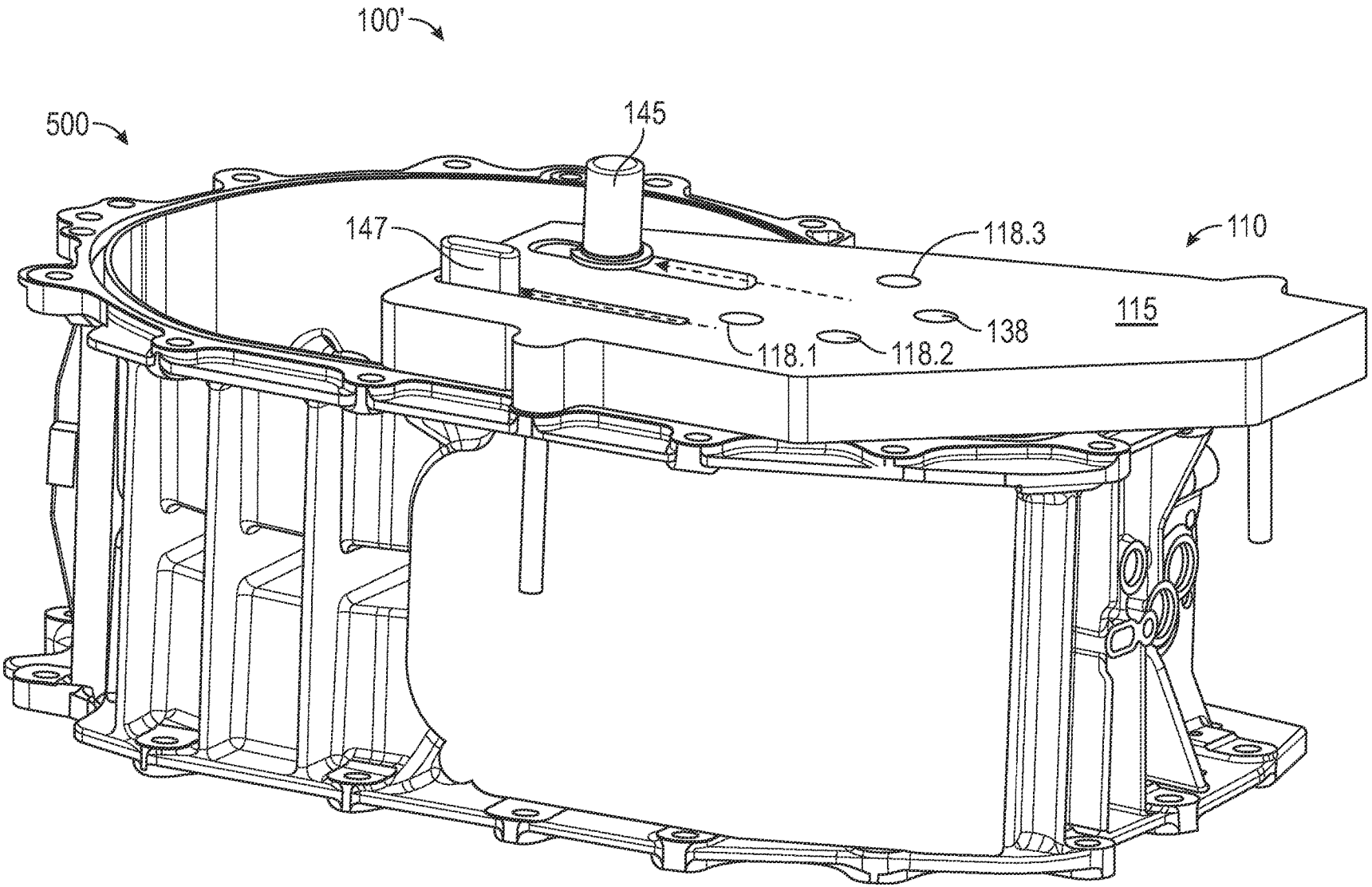

In many embodiments, opening 116.1 has an oval or rectangular shape, and is configured to guide the translation or displacement of clamp 140 from the disengaged position (see, e.g., FIG. 4B) to the engaged position (see, e.g., FIG. 4C), and from the engaged position (see, e.g., FIG. 5B) to the disengaged position (see, e.g., FIG. 5C). In certain embodiments, opening 116.2 also has an oval or rectangular shape, and is also configured to guide the translation or displacement of clamp 140 from the disengaged position to the engaged position, and from the engaged position to the disengaged position. Openings 116.1 and 116.2 cooperate to provide stability during the translation or displacement of clamp 140 along upper surface 114, and to prevent undesired rotation about an axis perpendicular to upper surface 114.

In many embodiments, openings 118.1, 118.2, 118.3 may be configured as witness holes to confirm the alignment of openings 310.1, 310.2, 310.5 in the port plate (see FIG. 3) with respective attachment points in the housing (such as threaded inserts, etc.). In certain embodiments, openings 118.1, 118.2, 118.3 may also be configured to receive fasteners (such as bolts, etc.) that attach the port plate to the housing prior to the removal of inverted pump assembly fixture from the housing (as described with reference to FIG. 6C).

In many embodiments, openings 117.1, 117.2 may be configured to receive housing dowels 119.1, 119.2, respectively, that are configured to align frame 110 to the housing during assembly.

Raised portion 122 extends from body 112, and includes upper surface 124 that is configured to support the lower surface of the port plate. Raised portion 122 defines a number of openings that extend from upper surface 124, through raised portion 122 and body 112, to lower surface 115. In many embodiments, openings 128.1, 128.2 are configured to receive port plate dowels 129.1, 129.2, respectively, which extend from raised portion 122. Port plate dowels 129.1, 129.2 are configured to align the port plate to upper surface 124. Raised portion 122 also defines recess 123 that is configured to receive a circumferential portion of a drive gear disk. Advantageously, recess 123 may be configured to only receive a drive gear disk that has the correct dimension(s), such as diameter, etc., which prevents the installation of an incorrectly-dimensioned drive gear.

Raised portion 132 extends from body 112, and includes upper surface 134 that is configured to support a recessed portion of the drive gear disk. Advantageously, raised portion 132 may be configured to only receive a recessed disk portion that has the correct dimension(s), such as diameter, etc., which prevents the installation of an incorrectly-dimensioned drive gear. In many embodiments, raised portion 132 may define opening 138 that extends from upper surface 134, through raised portion 132 and body 112, to lower surface 115. Opening 138 may be configured as a witness hole to confirm the alignment of the drive gear, and as an access passage to the drive gear (as described with reference to FIG. 6C).

Clamp 140 includes body 142, upper handle 144, lower handle 145 (see FIG. 5A, etc.) support arm 146 with support extension 147 (see FIG. 5A, etc.), lower arms 148.1, 148.2, and upper arms 150.1, 150. FIG. 1 depicts clamp 140 in the disengaged position.

In many embodiments, lower arms 148.1, 148.2 define lower recess 149 that is configured to receive a circumferential portion of the drive gear when clamp 140 is disposed in the engaged position. Similarly, upper arms 150.1, 150 define upper recess 151 that is configured to receive a portion of the pump gear set when clamp 140 is disposed in the engaged position. Lower arms 148.1, 148.2 may form a pair of lower arms, and upper arms 150.1, 150 may form a pair of upper arms. In many embodiments, upper arms 150.1, 150.2 include retention devices 152.1, 152.2, respectively, that secure the pump gear set when clamp 140 is disposed in the engaged position. Retention devices 152.1, 152.2 may be spring clips, spring plungers, ball-nose spring plungers, etc. Advantageously, upper recess 151 may be configured to only receive a pump gear set that has the correct dimension(s), such as diameter, etc., which prevents the installation of an incorrectly-dimensioned gear pump set.

Figure 2:
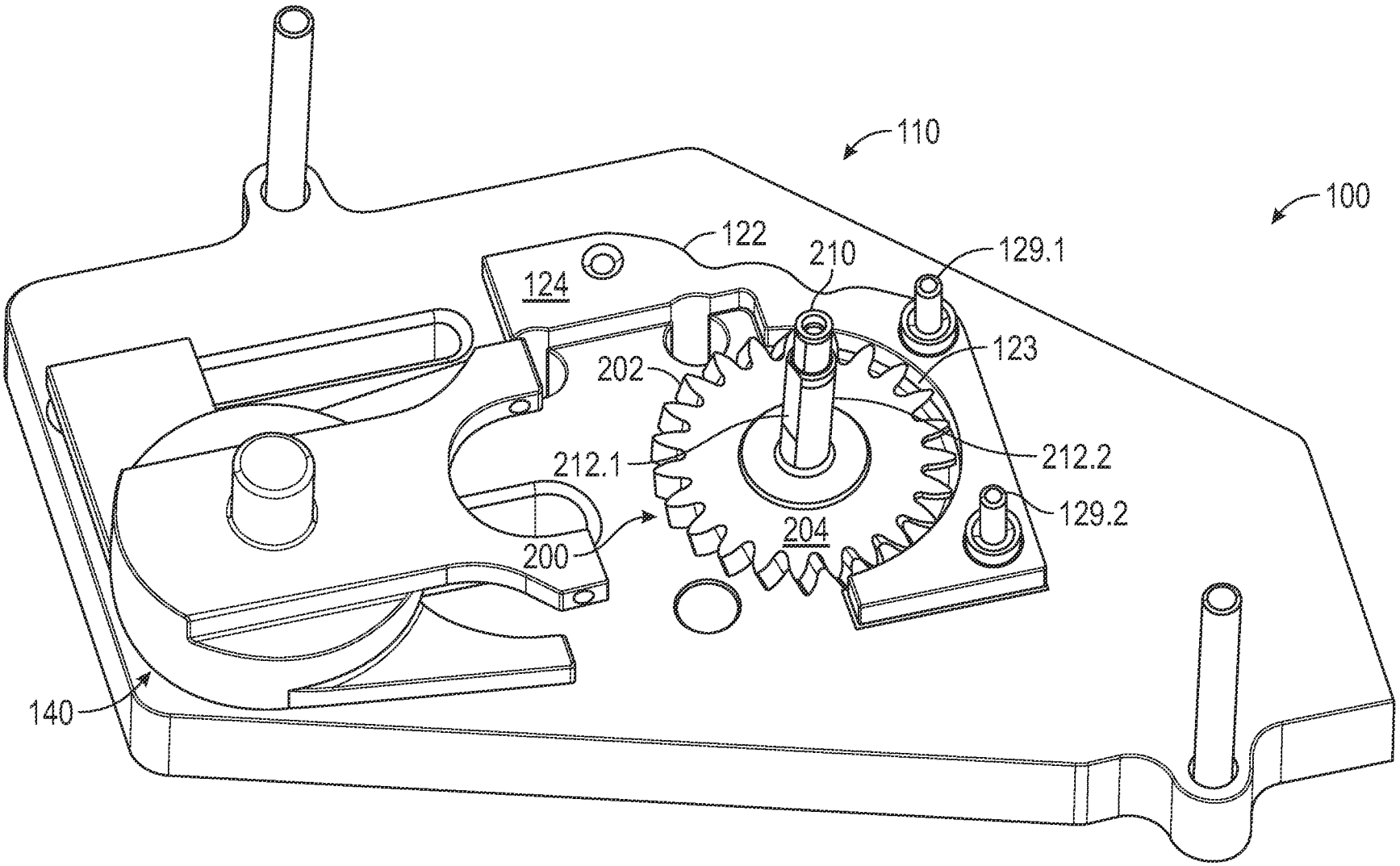
FIG. 2 depicts an example pump assembly fixture and drive gear, in accordance with embodiments of the present disclosure.

FIG. 2 depicts pump assembly fixture 100 and drive gear 200, in accordance with embodiments of the present disclosure.

In many embodiments, drive gear 200 includes, inter alia, gear teeth 202 arranged around the circumference of gear disk 204, and drive shaft 210. Recessed gear disk portion 206 (see FIGS. 6A, 6B) cooperates with raised portion 132 to align drive gear 200 to frame 110. In certain embodiments, drive shaft 210 includes flat surfaces 212.1, 212.2 that are configured to couple drive shaft 210 to the pump gear set.

In many embodiments, the initial step for installing pump components into a housing using pump assembly fixture 100 is to load, place, etc. drive gear 200 onto upper surface 134 of raised portion 132 such that recess 123 receives and contacts a circumferential portion of drive gear 200.

For convenience, frame 110, raised portion 122, upper surface 124, clamp 140, and port plate dowels 129.1, 129.2 are also identified.

Figure 3:
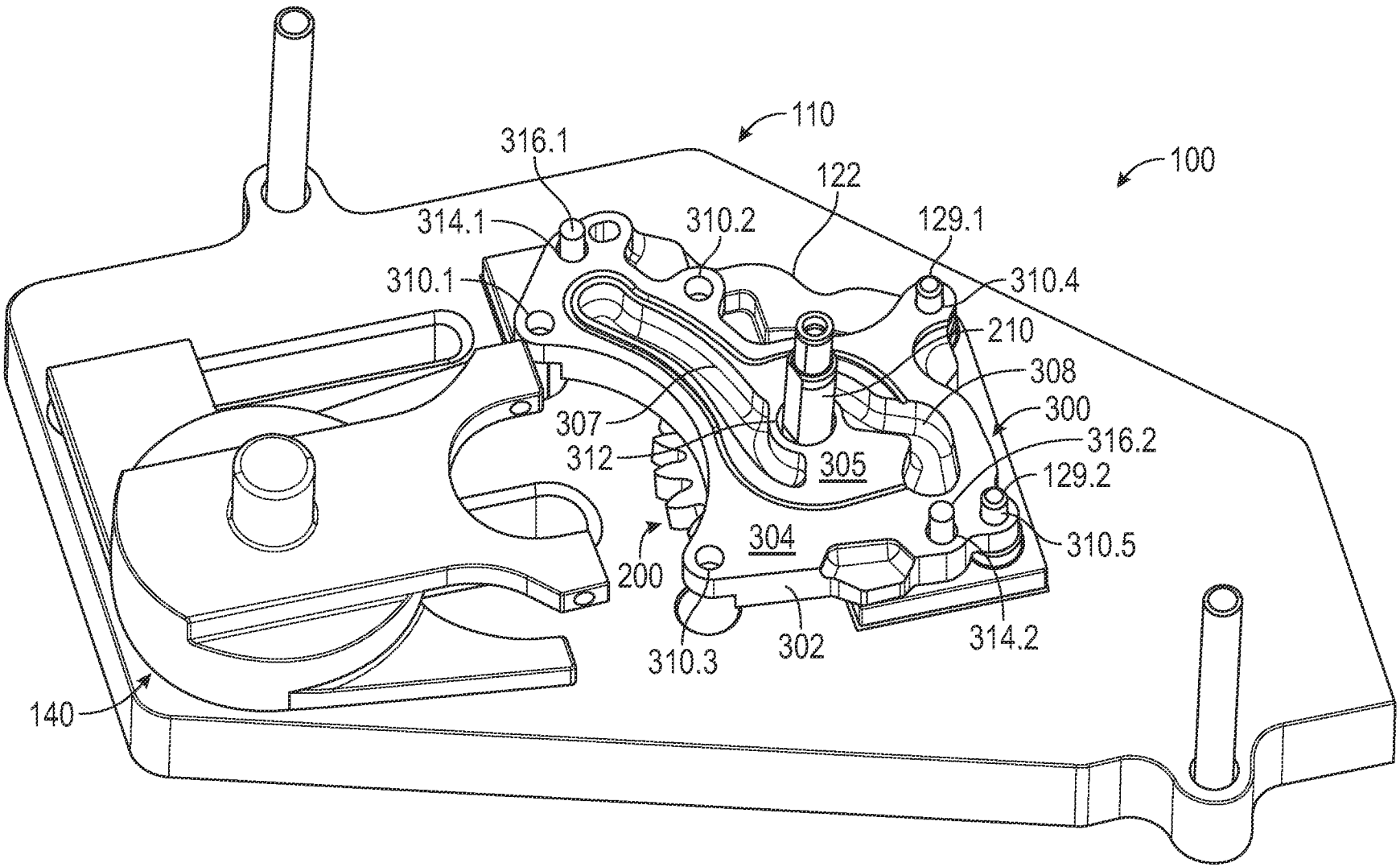
FIG. 3 depicts an example pump assembly fixture, drive gear, and port plate, in accordance with embodiments of the present disclosure.

FIG. 3 depicts pump assembly fixture 100, drive gear 200, and port plate 300, in accordance with embodiments of the present disclosure.

In many embodiments, port plate 300 includes, inter alia, body 302 that has upper surface 304 and raised upper surface 305. Body 302 and raised upper surface 305 cooperatively define inlet passage 307 and outlet passage 308, while body 302 defines and a number of openings that extend from upper surface 304 to lower surface 306. In many embodiments, openings 310.1, 310.2, 310.3, 310.4, 310.5 may be configured to receive fasteners (such as bolts, etc.) that attach port plate 300 to the housing, such as fasteners 700.1, 700.2, 700.3, 700.4, 700.5, respectively (see FIGS. 7A, 7B). In many embodiments, openings 310.4, 310.5 may be configured to initially receive port plate dowels 129.1, 129.2, respectively, to align port plate 300 on upper surface 124 of raised portion 122, which are subsequently removed so that fasteners 700.4, 700.5, may be inserted.

Opening 312 may be configured to receive drive shaft 210 which also aligns port plate 300 on upper surface 124 of raised portion 122. In many embodiments, openings 314.1, 314.2 may be configured to receive housing alignment dowels 316.1, 316.2, respectively, to align port plate 300 to the housing during assembly. Advantageously, opening 312 may be configured to only receive a drive shaft that has the correct dimension(s), such as maximum diameter, etc., which prevents the installation of an incorrectly-dimensioned drive gear.

In many embodiments, the next step for installing pump components into a housing using pump assembly fixture 100 is to load, place, etc. port plate 300 onto upper surface 124 of raised portion 122 while aligning drive shaft 210 within opening 312, and aligning port plate dowels 129.1, 129.2 within openings 310.4, 310.5, respectively.

For convenience, frame 110, clamp 140, drive gear 200, and drive shaft 210 are also identified.

Figure 4A:
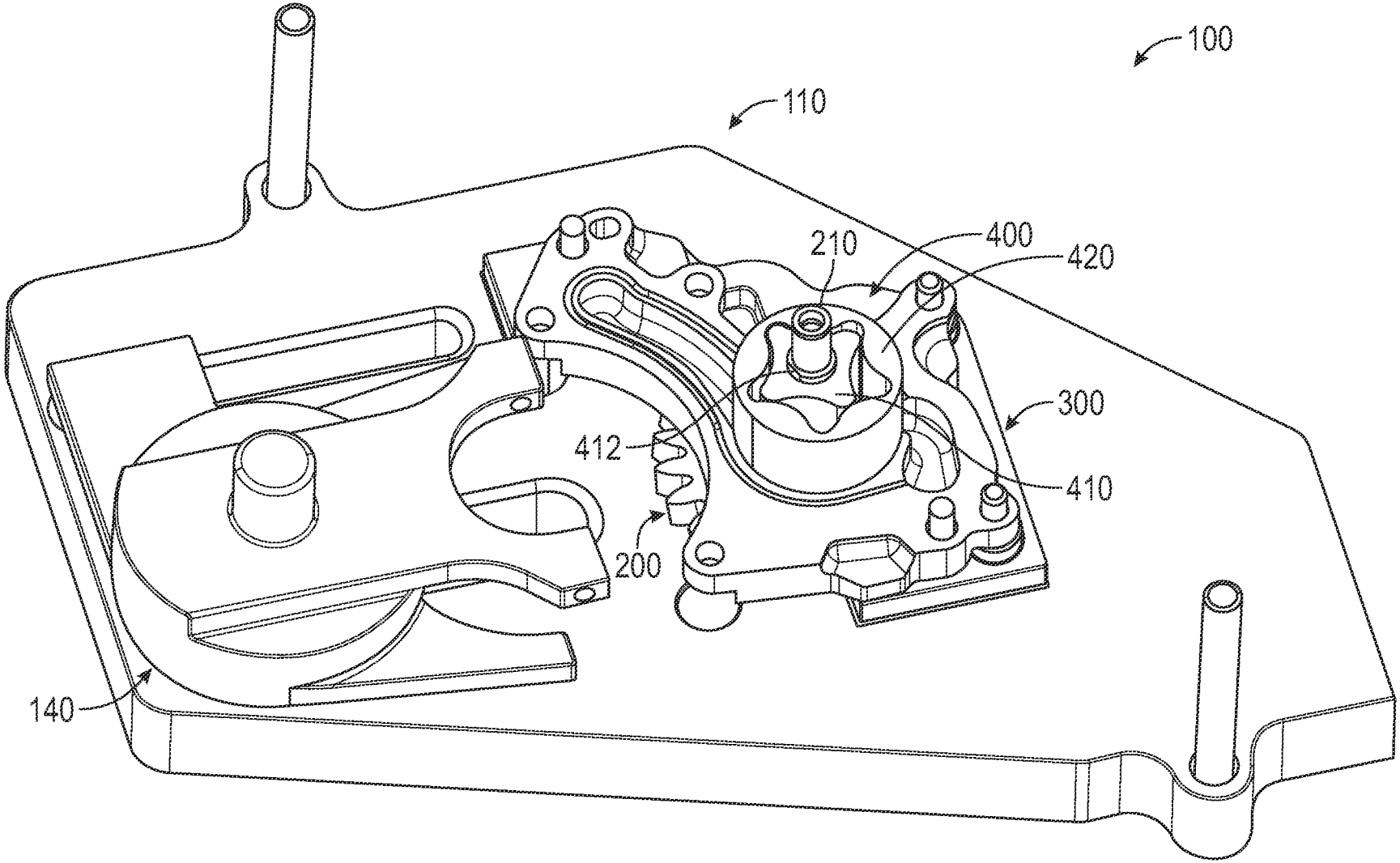
FIGS. 4A, 4B and 4C depict an example pump assembly fixture, drive gear, port plate, and pump gear set, in accordance with embodiments of the present disclosure.

FIG. 4A depicts pump assembly fixture 100, drive gear 200, port plate 300, and pump gear set 400, in accordance with embodiments of the present disclosure.

In many embodiments, pump gear set 400 includes, inter alia, inner gear 410 and outer gear 420. Generally, inner gear 410 defines inner passage 412 that is configured to receive drive shaft 210. In certain embodiments, inner passage 412 includes flat surfaces that are configured to cooperate with flat surfaces 212.1, 212.2 of drive shaft 210 to couple drive shaft 210 to pump gear set 400. In other embodiments, drive shaft 210 may include a spline and inner passage 412 may include a keyway to couple drive shaft 210 to pump gear set 400. Other coupling mechanisms are also contemplated.

In many embodiments, the next step for installing pump components into a housing using pump assembly fixture 100 is to load, place, etc. pump gear set 400 onto drive shaft 210, sliding pump gear set 400 down drive shaft 210 until at least a portion of the lower surfaces of inner gear 410 and outer gear 420 are resting on raised upper surface 305 of port plate 300.

For convenience, frame 110 and clamp 140 are also identified.

FIG. 4B depicts pump assembly fixture 100, drive gear 200, port plate 300, and pump gear set 400, in accordance with embodiments of the present disclosure.

In certain embodiments, snap ring 430 may be installed on drive shaft 210 to secure pump gear set 400 to drive shaft 210. Other securing mechanisms are also contemplated, such as a press fit, etc.

For convenience, frame 110 and clamp 140 are also identified.

FIG. 4C depicts pump assembly fixture 100, drive gear 200, port plate 300, and pump gear set 400, in accordance with embodiments of the present disclosure.

In many embodiments, the next step for installing pump components into a housing using pump assembly fixture 100 is to move, translate, displace, etc. clamp 140 from the disengaged position to the engaged position using upper handle 144, body 142, lower handle 145, support arm 146, etc. The dotted arrows indicate the direction of movement, translation, displacement, etc. When clamp 140 is disposed in the engaged position, lower recess 149 receives and contacts a circumferential portion of drive gear 200, upper recess 151 receives and contacts a circumferential portion of the outer surface of outer gear 420, and retention devices 152.1, 152.2 engage outer gear 420 to secure pump gear set 400 to clamp 140.

For convenience, frame 110, drive shaft 210, and inner gear 410 are also identified.

FIG. 5A depicts inverted pump assembly fixture 100', drive gear 200, port plate 300, pump gear set 400, and housing 500, in accordance with embodiments of the present disclosure.

Housing 500 includes, inter alia, body 510 and flange 512 that defines a number of openings that are configured to receive fasteners (such as bolts, etc.) to attach an upper cover to housing 500, to attach one or more external components to housing 500, etc. In many embodiments, openings 514.1, 514.2 may be configured to receive housing dowels 119.1, 119.2 to align inverted pump assembly fixture 100', to which drive gear 200, port plate 300, pump gear set 400 have been secured (see FIG. 4C), to housing 500.

In many embodiments, the next steps for installing pump components into a housing are to invert pump assembly fixture 100 such that the orientation of upper surface 114 and lower surface 115 are reversed, and then align inverted pump assembly fixture 100' to housing 500 using housing dowels 119.1, 119.2 and openings 514.1, 514.2 in flange 512. Slip ring 143 couples or secures lower handle 145 of clamp 140 to frame 110 to prevent clamp 140 from falling off frame 110 when pump assembly fixture 100 is inverted. Similarly, drive gear 200, port plate 300, pump gear set 400 are secured to frame 110 by clamp 140 to prevent these components from falling off frame 110 when pump assembly fixture 100 is inverted. Inverted pump assembly fixture 100' is depicted in a raised position above housing 500, and clamp 140 is depicted in the engaged position.

For convenience, frame 110, drive shaft 210, openings 116.1, 116.2, 118.1, 1181.2, 118.3, 138, lower handle 145 and support extension 147 are also identified.

FIG. 5B depicts inverted pump assembly fixture 100' and housing 500, in accordance with embodiments of the present disclosure.

Figure 6A:
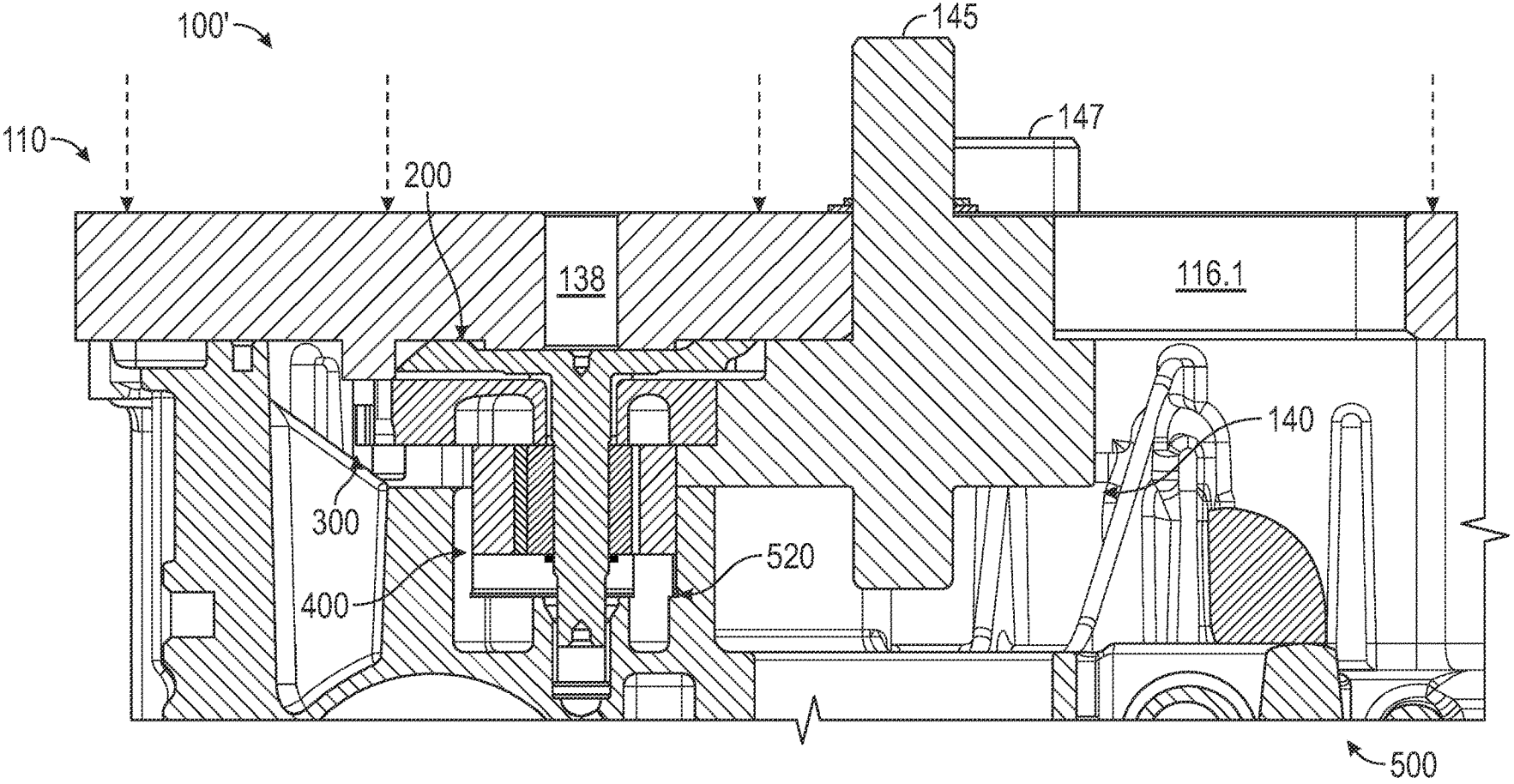
FIGS. 6A, 6B and 6C depict cross section views of an example inverted pump assembly fixture, drive gear, port plate, pump gear set, and housing, in accordance with embodiments of the present disclosure.

In many embodiments, the next step for installing pump components into a housing is to move, translate, displace, etc. inverted pump assembly fixture 100' from the raised position to a lowered position such that certain portions of upper surface 114 of frame 110 rest on the upper surface of flange 512. In other words, inverted pump assembly fixture 100' is placed on the upper surface of flange 512 of housing 500. The dotted arrows indicate the direction of movement, translation, displacement, etc. Inverted pump assembly fixture 100' is depicted in the lowered position, and clamp 140 is depicted in the engaged position. FIG. 6A depicts a cross-section of this arrangement.

For convenience, lower surface 115, openings 118.1, 1181.2, 118.3, 138, lower handle 145 and support extension 147 are also identified.

FIG. 5C depicts inverted pump assembly fixture 100' and housing 500, in accordance with embodiments of the present disclosure.

Figure 6B:
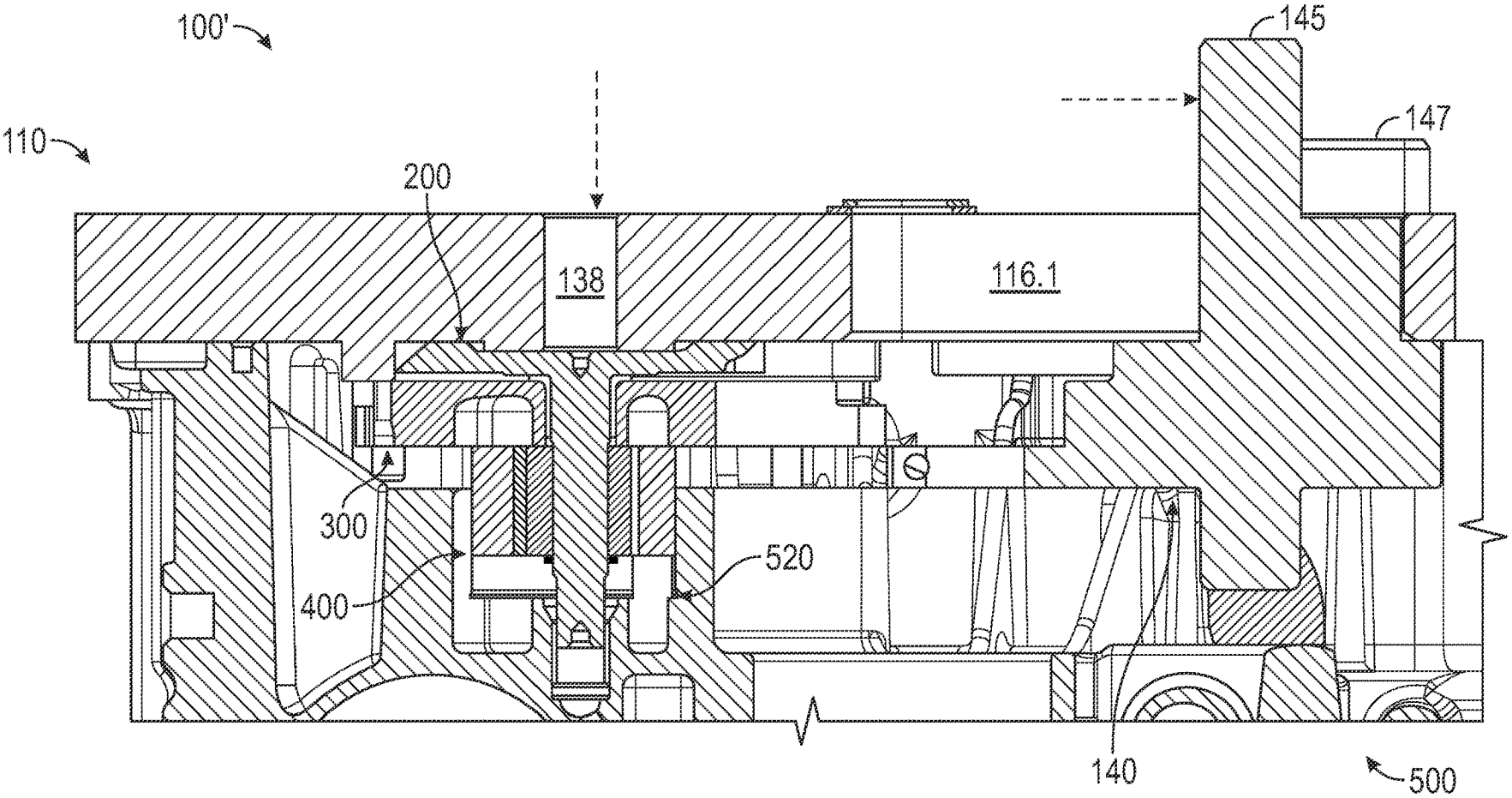

In many embodiments, the next step for installing pump components into a housing is to move, translate, displace, etc. clamp 140 from the engaged position to the disengaged position using lower handle 145 and/or support extension 147. The dotted arrows indicate the direction of movement, translation, displacement, etc. Inverted pump assembly fixture 100' is depicted in the lowered position, and lower handle 145 and support extension 147 of clamp 140 are depicted in the disengaged position. FIG. 6B depicts a cross-section of this arrangement.

For convenience, lower surface 115, openings 118.1, 1181.2, 118.3, 138 are also identified.

Figure 5D:
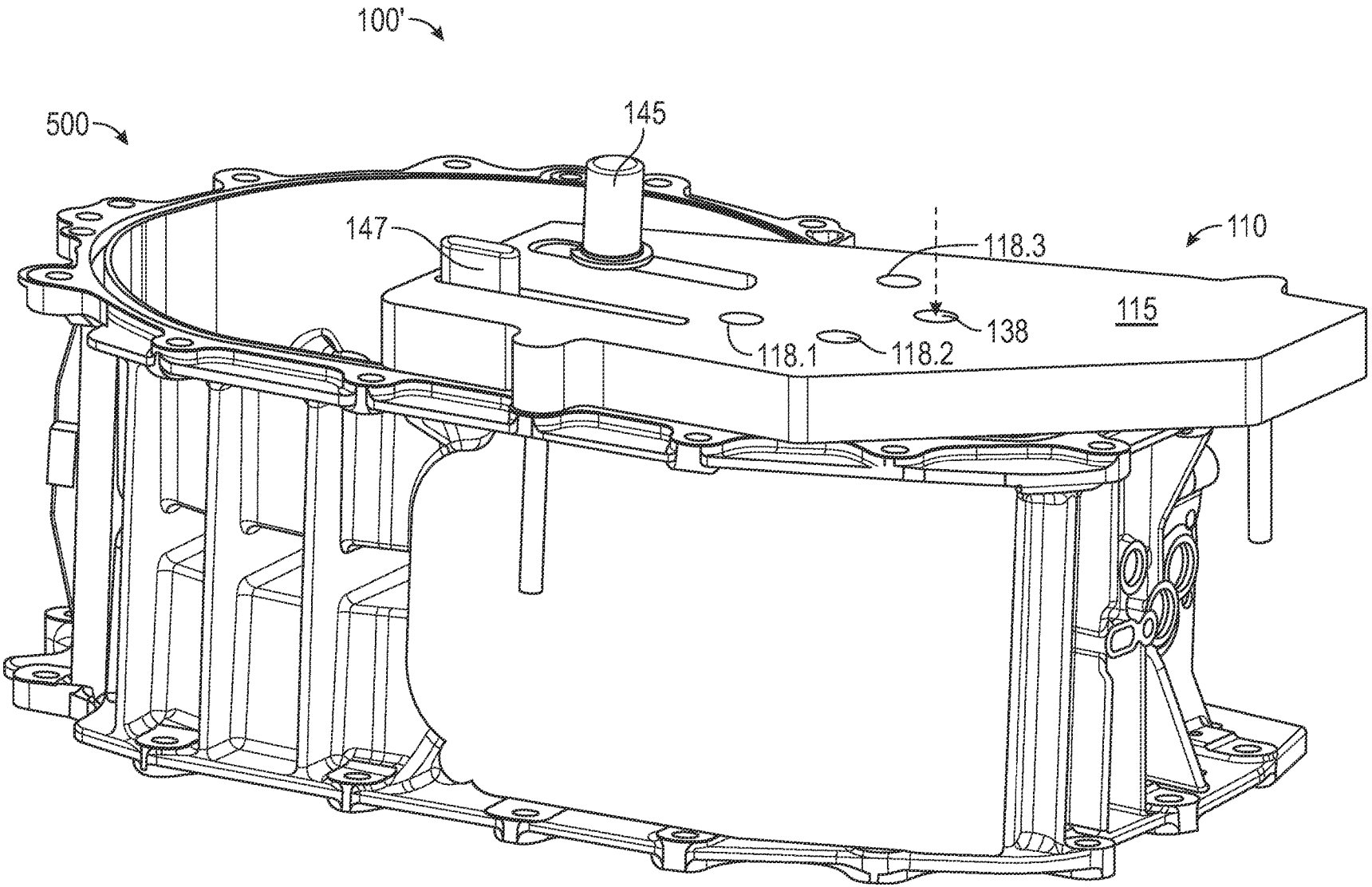

FIG. 5D depicts inverted pump assembly fixture 100' and housing 500, in accordance with embodiments of the present disclosure.

Figure 6C:
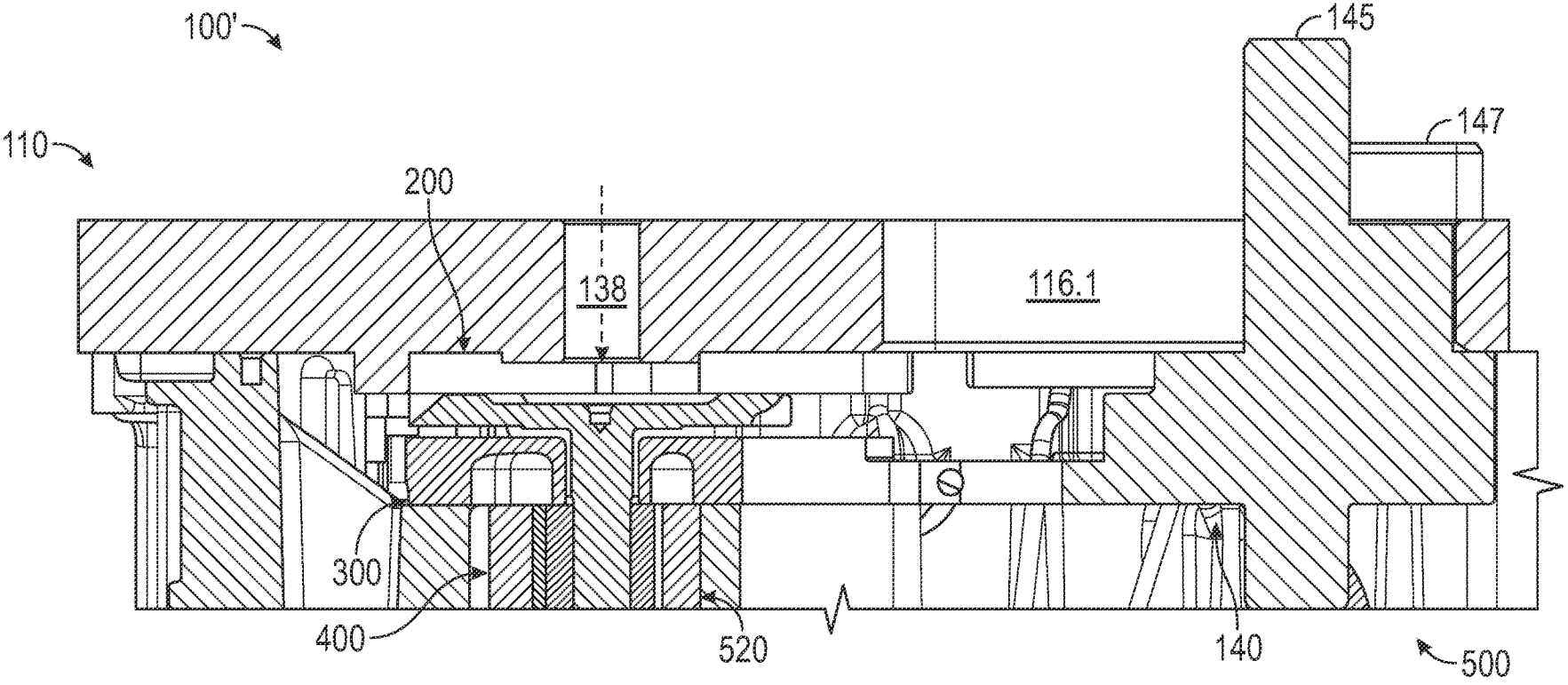

In many embodiments, the next step for installing pump components into a housing is to move, translate, displace, etc. drive gear 200, port plate 300 and pump gear set 400 into the pump chamber of housing 500. The dotted arrow indicates the direction of movement, translation, displacement, etc. Inverted pump assembly fixture 100' is depicted in the lowered position, and lower handle 145 and support extension 147 of clamp 140 are depicted in the disengaged position. FIG. 6C depicts a cross-section of this arrangement.

For convenience, lower surface 115, openings 118.1, 1181.2, 118.3, 138 are also identified.

FIG. 6A depicts a cross section view of inverted pump assembly fixture 100', drive gear 200, port plate 300, pump gear set 400, and housing 500, in accordance with embodiments of the present disclosure.

Inverted pump assembly fixture 100' is depicted in the lowered position, and clamp 140 is depicted in the engaged position (see FIG. 5B). For convenience, frame 110, openings 116.1, 138, lower handle 145, support extension 147, and pump chamber 520 of housing 500 are also identified.

FIG. 6B depicts a cross section view of inverted pump assembly fixture 100', drive gear 200, port plate 300, pump gear set 400, and housing 500, in accordance with embodiments of the present disclosure.

Inverted pump assembly fixture 100' is depicted in the lowered position, and clamp 140 is depicted in the disengaged position (see FIG. 5C). For convenience, frame 110, openings 116.1, 138, lower handle 145, support extension 147, and pump chamber 520 of housing 500 are also identified.

FIG. 6C depicts a cross section view of inverted pump assembly fixture 100', drive gear 200, port plate 300, pump gear set 400, and housing 500, in accordance with embodiments of the present disclosure.

Inverted pump assembly fixture 100' is depicted in the lowered position, clamp 140 is depicted in the disengaged position, and drive gear 200, port plate 300 and pump gear set 400 are disposed in pump chamber 520 of housing 500. (see FIG. 5D). For convenience, frame 110, openings 116.1, 138, lower handle 145, and support extension 147 are also identified.

In many embodiments, after drive gear 200, port plate 300 and pump gear set 400 have been displaced into pump chamber 520 of housing 500, the next step for installing pump components into a housing is to simply remove inverted pump assembly fixture 100' from housing 500. In certain embodiments, fasteners 700.1, 700.2, 700.3 may be inserted through openings 118.1, 118.2, 118.3, respectively, to partially attach port plate 300 to housing 500 prior to the removal of inverted pump assembly fixture 100' from housing 500.

Figure 7A:
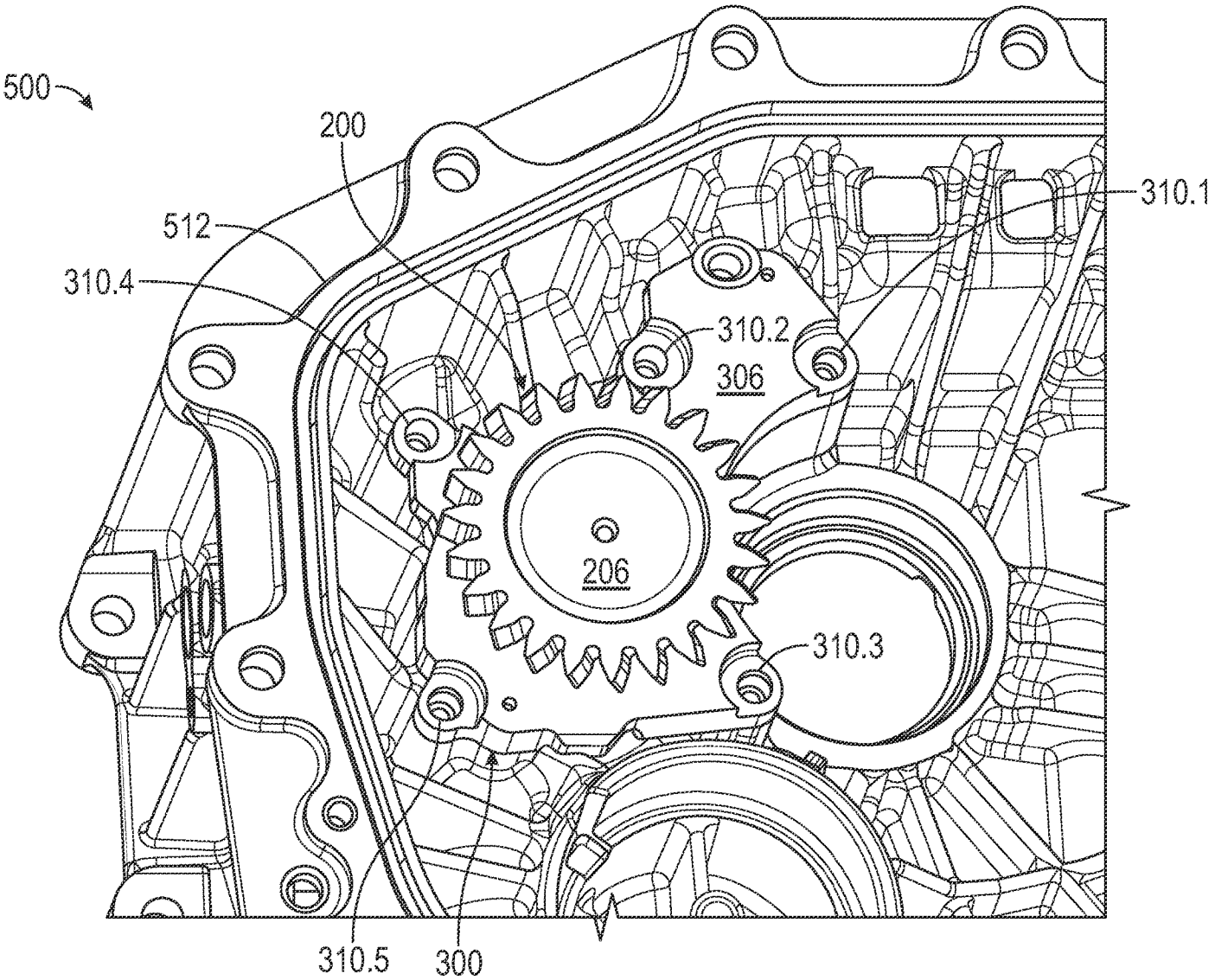
FIGS. 7A and 7B depict an example drive gear, port plate, and housing, in accordance with embodiments of the present disclosure.
Figure 7B:
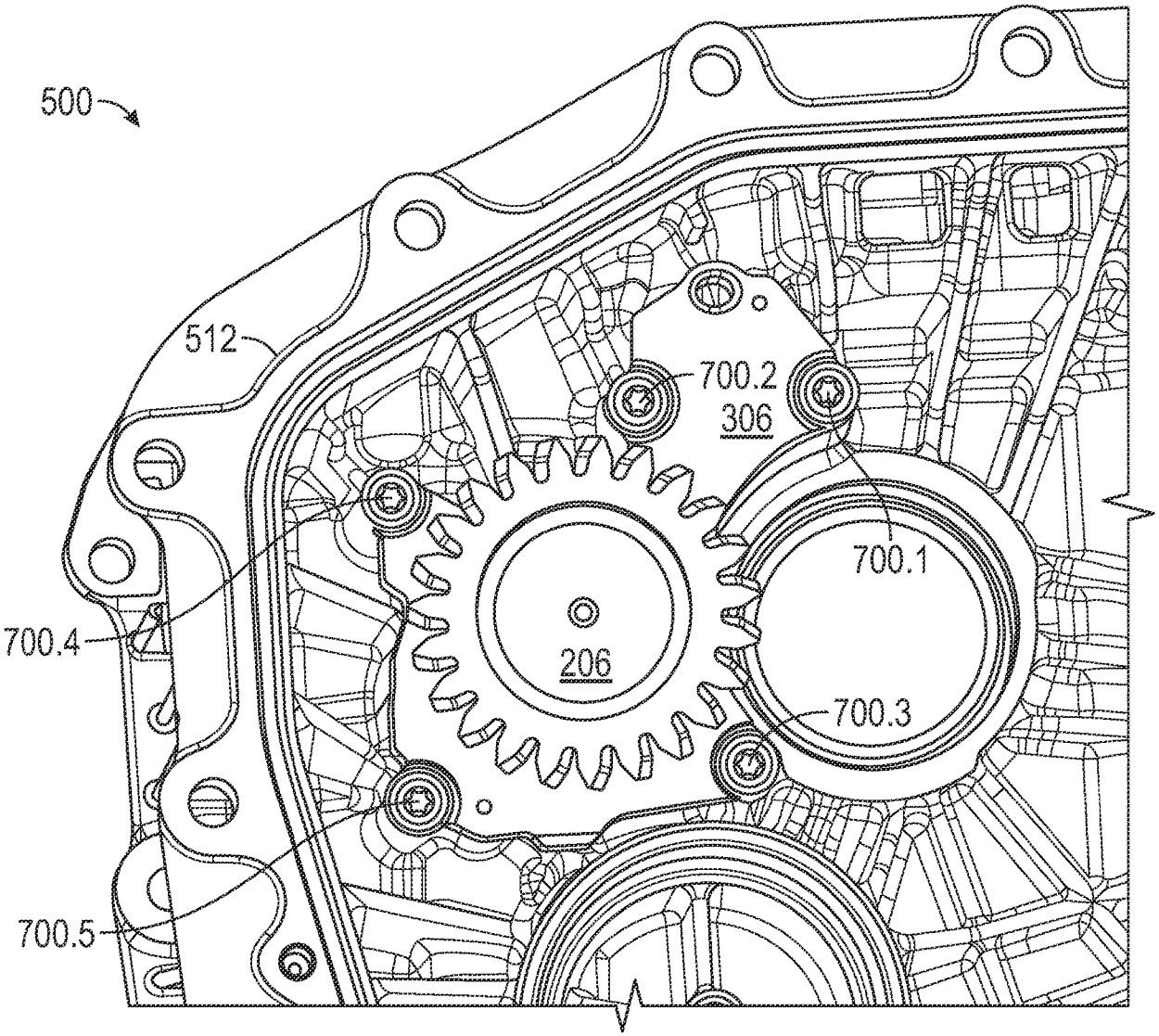

FIGS. 7A and 7B depicts drive gear 200, port plate 300, and housing 500, in accordance with embodiments of the present disclosure.

After inverted pump assembly fixture 100' has been removed from housing 500 exposing lower surface 306 of port plate 300, openings 310.1, 310.2, 310.3, 310.4, 310.5 can be seen to align with the respective attachment points in housing 500 (such as threaded inserts, etc.) in FIG. 7A.

In many embodiments, the final step for installing pump components into a housing is to attach port plate 300 to the respective attachment points in housing 500 using fasteners 700.1, 700.2, 700.3, 700.4, 700.5 as depicted in FIG. 7B.

Figure 8:
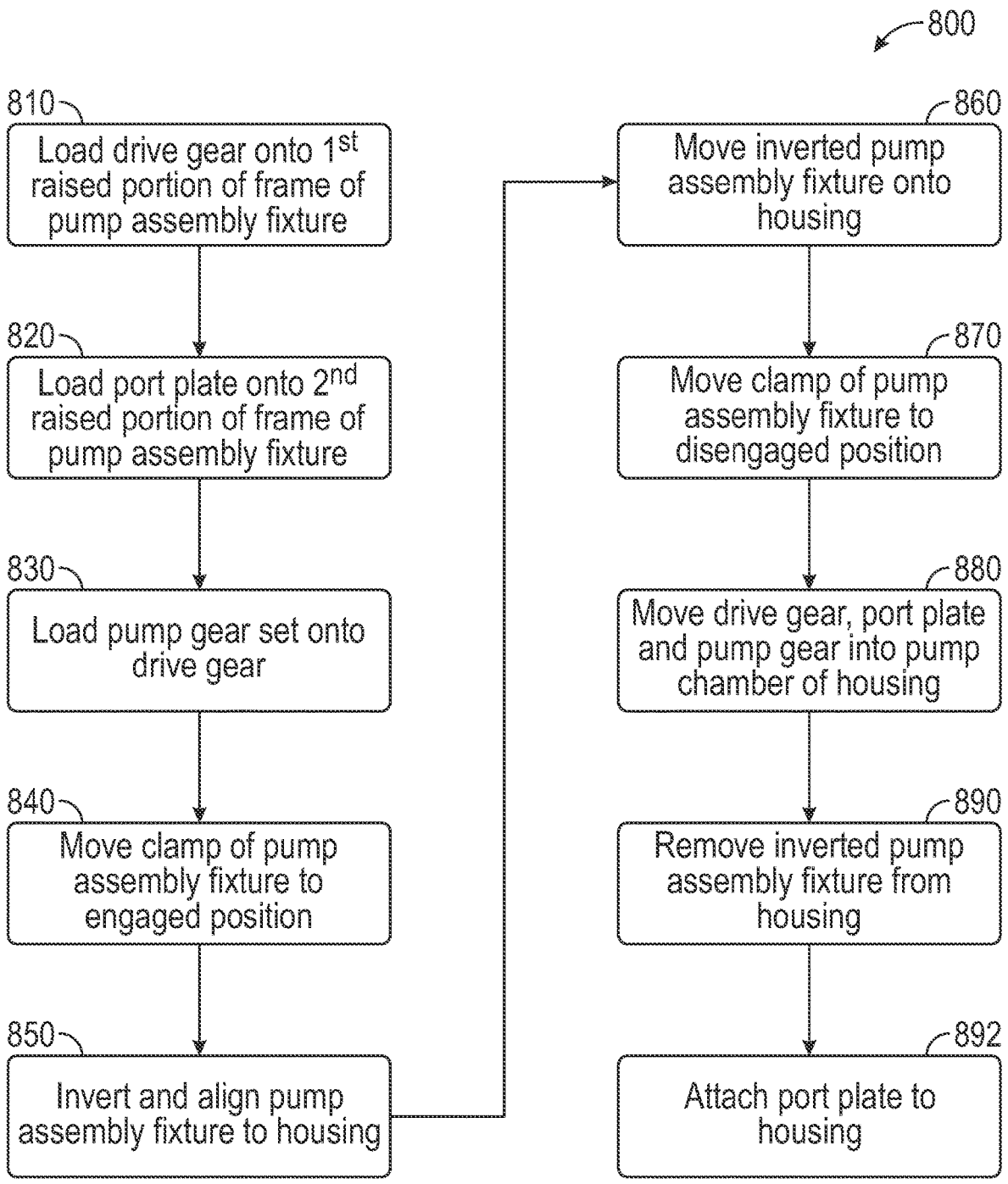
FIG. 8 depicts a flow chart representing functionality associated with facilitating the installation of pump components into a housing, in accordance with embodiments of the present disclosure.

FIG. 8 depicts flow chart 800 representing functionality associated with facilitating the installation of pump components into housing 500, in accordance with embodiments of the present disclosure.

At 810, drive gear 200 is loaded, placed, etc. onto upper surface 134 of raised portion 132 such that recess 123 receives and contacts a circumferential portion of drive gear 200.

At 820, port plate 300 is loaded, placed, etc. onto upper surface 124 of raised portion 122 while aligning drive shaft 210 within opening 312, and aligning port plate dowels 129.1, 129.2 within openings 310.4, 310.5, respectively.

At 830, pump gear set 400 is loaded, placed, etc. onto drive shaft 210 by sliding pump gear set 400 down drive shaft 210 until at least a portion of the lower surfaces of inner gear 410 and outer gear 420 are resting on raised upper surface 305 of port plate 300. In certain embodiments, snap ring 430 may be installed on drive shaft 210 to secure pump gear set 400 to drive shaft 210. Other securing mechanisms are also contemplated.

At 840, clamp 140 is moved, translated, displaced, etc., from the disengaged position to the engaged position using upper handle 144, body 142, lower handle 145, support arm 146, etc. When clamp 140 is disposed in the engaged position, lower recess 149 receives and contacts a circumferential portion of drive gear 200, upper recess 151 receives and contacts a circumferential portion of the outer surface of outer gear 420, and retention devices 152.1, 152.2 engage outer gear 420 to secure pump gear set 400 to clamp 140.

At 850, pump assembly fixture 100 is inverted such that the orientation of upper surface 114 and lower surface 115 are reversed, and then inverted pump assembly fixture 100' is aligned to housing 500 using housing dowels 119.1, 119.2 and openings 514.1, 514.2 in flange 512.

At 860, inverted pump assembly fixture 100' is moved, translated, displaced, etc., from the raised position to the lowered position such that certain portions of upper surface 114 of frame 110 rest on the upper surface of flange 512. In other words, inverted pump assembly fixture 100' is placed on the upper surface of flange 512 of housing 500.

At 870, clamp 140 is moved, translated, displaced, etc., from the engaged position to the disengaged position using lower handle 145 and/or support extension 147.

At 880, drive gear 200, port plate 300 and pump gear set 400 are moved, translated, displaced, etc., into pump chamber 520 of housing 500.

At 890, inverted pump assembly fixture 100' is removed from housing 500.

At 892, port plate 300 is attached to the respective attachment points in housing 500 using fasteners 700.1, 700.2, 700.3, 700.4, 700.5.

The many features and advantages of the disclosure are apparent from the detailed specification, and, thus, it is intended by the appended claims to cover all such features and advantages of the disclosure which fall within the scope of the disclosure. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

What is claimed is:

1. An apparatus to facilitate installation of pump components into a housing, the apparatus comprising:

a frame configured to be placed on a housing during assembly, the frame including:

a body, a first raised portion extending from the body, the first raised portion configured to support a portion of a drive gear, and a second raised portion extending from the body, the second raised portion configured to support a portion of a port plate; and a clamp slidingly coupled to the frame, the clamp configured to secure the drive gear, the port plate, and a pump gear set to the frame, and to release the drive gear, the port plate, and the pump gear set from the frame, wherein the pump gear set is coupled to the drive gear.

2. The apparatus of claim 1, wherein:

the clamp has a disengaged position and an engaged position;

the disengaged position is configured to allow placement of the drive gear onto the first raised portion, placement of the port plate onto the second raised portion, and placement of the pump gear set onto the drive gear; and the engaged position is configured to secure the drive gear, the port plate, and the pump gear set to the frame.

3. The apparatus of claim 2, wherein:

the drive gear includes a gear disk and a drive shaft; and the pump gear set includes an inner gear and an outer gear.

4. The apparatus of claim 3, wherein the second raised portion defines a recess configured to receive a first circumferential portion of the gear disk.

5. The apparatus of claim 4, wherein the clamp includes a pair of lower arms defining a lower recess configured to receive a second circumferential portion of the gear disk.

6. The apparatus of claim 5, wherein the clamp includes a pair of upper arms defining an upper recess configured to receive a circumferential portion of the outer gear.

7. The apparatus of claim 6, wherein each upper arm of the pair of upper arms includes a retention device to secure the pump gear set when the clamp is disposed in the engaged position.

8. The apparatus of claim 7, wherein the retention device is a spring clip or a spring plunger.

9. The apparatus of claim 8, wherein the retention device is a ball-nose spring plunger.

10. The apparatus of claim 3, wherein the inner gear is coupled to the drive shaft by one or more cooperating surfaces.

11. The apparatus of claim 10, wherein the inner gear is retained on the drive shaft with a snap ring.

12. The apparatus of claim 11, wherein the pump gear set is a gerotor gear set.

13. The apparatus of claim 1, further comprising:

a plurality of housing dowels extending from the body, the housing dowels configured to align the frame to the housing.

14. The apparatus of claim 1, further comprising:

a plurality of port plate dowels extending from the second raised portion, the port plate dowels configured to align the port plate to the second raised portion.

15. The apparatus of claim 14, wherein the port plate includes:

a body defining an inlet passage, an outlet passage, and a number of openings, each opening configured to receive a fastener therethrough; and a raised upper surface that is configured to contact a portion of the pump gear set.

16. The apparatus of claim 15, wherein at least two of the number of openings are each configured to receive one of the port plate dowels.

17. A method to facilitate installation of pump components into a housing, the method comprising:

loading a drive gear, a port plate and a pump gear set onto a pump assembly fixture;

inverting the pump assembly fixture;

moving the inverted pump assembly fixture onto the housing;

moving the drive gear, the port plate and the pump gear set into the housing;

removing the inverted pump assembly fixture from the housing; and attaching the port plate to the housing.

18. The method of claim 17, wherein the loading the drive gear, the port plate and the pump gear set includes:

loading the drive gear onto a first raised portion of a frame of the pump assembly fixture;

loading the port plate onto a second raised portion of the frame while aligning a drive shaft of the drive gear within an opening in the port plate;

loading the pump gear set onto the drive gear;

moving a clamp of the pump assembly fixture to an engaged position to secure the drive gear, the port plate and the pump gear set to the frame; and after the inverted pump assembly fixture is moved onto the housing, the method further comprises moving the clamp to a disengaged position to release the drive gear, the port plate, and the pump gear set from the frame.

19. The method of claim 18, wherein the inverting the pump assembly fixture includes aligning a plurality of housing dowels with respective openings in the housing.

* * * * *